US006672579B2

(12) United States Patent
Araki et al.

(10) Patent No.: US 6,672,579 B2
(45) Date of Patent: Jan. 6, 2004

(54) PRESSING FORCE ADJUSTABLE ROLLER UNIT, TRANSPORT SYSTEM OF SHEET MEMBER IN IMAGE PROCESSING APPARATUS THEREWITH AND SUPPLY SYSTEM OF SHEET MEMBER IN IMAGE PROCESSING APPARATUS

(75) Inventors: Takao Araki, Kasuga (JP); Kosuke Takaki, Kasuga (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 21 days.

(21) Appl. No.: 09/748,130

(22) Filed: Mar. 6, 2001

(65) Prior Publication Data

US 2001/0020765 A1 Sep. 13, 2001

(30) Foreign Application Priority Data

| | | |
|---|---|---|
| Dec. 28, 1999 | (JP) | 11-373875 |
| Jan. 18, 2000 | (JP) | 2000-008907 |
| Feb. 2, 2000 | (JP) | 2000-025030 |
| Feb. 3, 2000 | (JP) | 2000-025948 |

(51) Int. Cl.[7] ..... B65H 3/52

(52) U.S. Cl. ..... 271/122; 271/125; 271/121; 271/124

(58) Field of Search ..... 271/274, 122, 271/125, 124, 121

(56) References Cited

U.S. PATENT DOCUMENTS 6,234,470 B1 * 5/2001 Okitsu et al. ..... 271/114

6,260,839 B1 * 7/2001 Araki et al. ..... 271/10.11

FOREIGN PATENT DOCUMENTS

JP 4286558 10/1992

* cited by examiner

*Primary Examiner*—Donald P. Walsh
*Assistant Examiner*—Jonathan R Miller

(57) ABSTRACT

There are disclosed a pressing force adjustable roller unit, a sheet member or transport system in an image processing apparatus provided with the roller unit, and a sheet member supply system in which multi-transport can securely be prevented. In a holder to which a roller is attached via a holding shaft to move the roller in a load direction from a peripheral surface, a torsion spring is connected in a direction in which the holding shaft is pressed downward, a windup degree of a winding portion of the torsion spring is adjusted by engagement of an engaging arm projecting from the winding portion with a first or second stopper disposed on a holder side, and a roller pressing force can therefore be adjusted. There are also provided a hopper for piling sheets, a supply roller for picking up and feeding out the sheet, and a multi-transport preventing roller pair of a separation roller and a retard roller so that the hopper can vertically move with respect to the supply roller. When the sheet multi-transport is detected by a multi-transport detection sensor, disposed on an immediate downstream side of the separation roller and retard roller, for detecting the sheet multi-transport, the hopper is shifted in a downward direction apart from the supply roller, a nipping force between the separation roller and retard roller is reduced, and a retard roller rotation torque is increased.

2 Claims, 14 Drawing Sheets

PRESSING FORCE ADJUSTABLE ROLLER UNIT, TRANSPORT SYSTEM OF SHEET MEMBER IN IMAGE PROCESSING APPARATUS THEREWITH AND SUPPLY SYSTEM OF SHEET MEMBER IN IMAGE PROCESSING APPARATUS

BACKGROUND OF THE INVENTION

1. Field of the Invention

The present invention relates to a roller unit in which a pressing force for nipping a sheet member or the like is adjustable, and a transport system of a sheet member in an image processing apparatus using the roller unit.

Moreover, the present invention relates to image reading apparatuses such as an image scanner for reading an original image, image forming apparatuses such as image processing apparatuses or the like in a copying machine or the like, and particularly, to a supply system of a sheet member in an image processing apparatus in which multi-transport of the sheet member can be prevented in a hopper sheet member supply method.

2. Description of Related Art

A roller is frequently used in various equipment fields and, for example, in a rolling line of a steel plate or a transport line of a flat-plate and large-sized material, equipment is usually constituted by arranging a large number of roller pairs on upper, lower and both sides of the line to guide or roll/mold the steel plate or the material. Not only in such large-sized equipment, but also in a field of so-called business machines for image formation or image reading, such as a copy machine, a facsimile apparatus, and an image scanner, various rollers are similarly utilized. For the roller of the business machine, an object to be nipped or guided is a sheet, and thus, a remarkably simplified and lightened structure is general in which, for example, resin is utilized.

The roller is used in various fields in this manner, and, when the steel plate is rolled or the sheet material is transported, and when the sheet is supplied or transported in the business machine, how to set a nipping force of the roller is very important. This nipping force is set in accordance with a distance between shafts of a pair of rollers or an elastic urging force which interacts between the rollers. Moreover, in the rolling equipment, the large-sized material transport equipment, and the like, the nipping force or a rolling force is adjusted by a hydraulic-pressure or pneumatic-pressure cylinder connected to the roller shaft, a link mechanism including a spring or the like. In the equipment including such cylinder and link mechanism, rigidity of a system for setting the nipping force or the rolling force is high, and occupied space therefor also increases.

On the other hand, even in the field associated with the business machine, a constitution for guiding paper and other sheet materials and transporting them due to a friction force by utilizing the pair of rollers, as described above, is employed. Even in such guiding or transporting by the pair of rollers, it is important to set the nipping force between the rollers. For example, in the image scanner, the nipping force before and after an image reading section is intensified to some degree so as to stabilize image reading. In simple guiding or transporting, the nipping force is preferably set to be slightly weak so as to prevent an excessively large tension from being applied to the sheet.

On the other hand, for the image scanner and other image reading or forming business machines, a very large number of components and circuits are incorporated in a limited space of a main body. Therefore, considering from the incorporated space, it is not practical to set the nipping force of the roller pair with the cylinder or link mechanism. This problem has been solved by incorporating the respective roller pair with higher position's accuracy and appropriately determining the distance between the shafts in order to set the nipping force.

However, in a case in which the nipping force is adjusted only with the distance between the shafts of the roller pair, if the incorporating precision of the roller pair is not higher, a desired object cannot be achieved. That is to say, since there is existed a manufacturing error of the roller itself and an incorporating error to a support member for supporting the roller, it is very difficult to set the nipping force with high-accuracy. Moreover, the support member for supporting the roller is securely disposed along a sheet transport path. Thus, if a position of the support member is fixed, change of the roller pair nipping force or another adjustment cannot be performed at all. Therefore, if the nipping force becomes too strong or weak in accordance with a sheet thickness or a paper quality, a function of transporting or guiding the sheet is deteriorated.

As described above, for the guiding roller of the large-sized equipment, the cylinder or the link mechanism can be used to arbitrarily change the roller nipping force. However, in the apparatus associated with the small-sized business machine, the nipping force of the guiding or transporting roller cannot be changed or adjusted, and this causes a problem that the image reading or the image formation is remarkably influenced.

The image reading apparatus such as an image scanner is provided, for example, with a sheet supply apparatus for feeding a sheet set on a hopper into the line. The sheet supply apparatus picks up and feeds out piled sheets one by one from the top, and is, in most cases, provided with a multi-transport preventing system for preventing two or more sheets from being fed by friction of the superposed sheets. The sheet supply apparatus provided with such multi-transport preventing system is described, for example, in JP-A-04-286558.

FIG. 16 is a schematic view showing a typical example of the conventional sheet supply apparatus provided with the multi-transport preventing system, and this apparatus has a constitution substantially similar to the constitution described in the aforementioned publication.

In FIG. 16, a hopper 51 for mounting and setting various types of sheets P such as document paper to be read is disposed on a base end of a reading line, and a supply roller 52 for picking up and feeding out an uppermost sheet P is disposed above the hopper 51. The hopper 51 is urged toward the supply roller 52 by a spring 51*a*, and the sheet P is pressed onto the supply roller 52 so that only the uppermost sheet P is fed out by friction with a peripheral surface of the roller. Moreover, even when a piled thickness of the sheets P changes, a pressing force to the supply roller 52 is held to be substantially constant by the spring 51*a*.

On a line of an exit side of the hopper 51, in order to feed the sheet P to an image reading position, for example, three pairs of transport rollers 53, 54, 55 are arranged so that the sheet P fed from the hopper 51 is nipped, drawn out and transported downstream. Moreover, between the hopper 51 and a first pair of transport rollers 53, a separation roller 56 and a retard roller 57 are disposed as a multi-transport preventing system of the sheet P.

Multi-transport prevention by the separation roller 56 and retard roller 57 is broadly known in fields of an image reading apparatus and copying machine, and the retard roller 57 is constituted by attaching a torque limiter 57*b* around a main shaft 57*a* which is rotated in a direction of an arrow shown in FIG. 16 by a driving motor (not shown). The main shaft 57*a* of the retard roller 57 is connected to the driving motor (not shown) commonly used for the separation roller 56, and is urged upward by a spring for setting the nipping force with the separation roller 56 in FIG. 16. Since such a torque limiter 57*b* is disposed, when one sheet P is fed from the supply roller 52, the retard roller 57 receives a rotation torque of the separation roller 56 to rotate in a transport direction of the sheet P. Moreover, when two or more sheets P are redundantly transported and nipped, the retard roller 57 keeps rotating in the arrow direction, and the redundantly transported lower sheet P is pushed back toward the hopper 51.

However, in the conventional retard roller 57, there is used a torque limiter 57*b* with a fixedly set torque value. That is to say, an operation torque of the torque limiter 57*b* cannot be changed in real time. On the other hand, in such a machine as an image scanner used for reading various types of sheets P, paper quality, thickness and friction coefficient of the sheet P changes variously in accordance with the sheet P. Therefore, when the operation torque of the torque limiter 57*b* is set to be constant, a multi-transport preventing function of the sheet P cannot sufficiently be fulfilled in cooperation with the separation roller 56. Particularly, when a large number of originals are read in the image scanner and an electronic file of the data thereof is performed, if multi-transport occurs and thus only one original is not read, the information to be stored becomes insufficient, and whereby, the sheet multi-transport raises a very important problem.

On the other hand, if a multi-transport detection sensor is disposed on the downstream side of the separation roller 56 and retard roller 57, when the multi-transport of the sheet P cannot be inhibited, multi-transport is detected, and thereby, it is possible to take operations of stopping the transport of the sheet P and returning the sheet back to the hopper 51 side. Furthermore, frequency of the multi-transport of the sheet P variously changes in accordance with the paper quality, thickness and friction coefficient of the sheet P, and the sheet is classified into a sheet which easily causes the multi-transport, and a sheet which does not easily cause the multi-transport. Therefore, when the sheet easily causing the multi-transport is supplied, by adjusting the torque of the torque limiter 57*b* and the nipping force by the separation roller 56 and retard roller 57, the multi-transport of the sheet P can effectively be prevented.

However, in the conventional structure, the set torque of the torque limiter 57*b* is fixed, and additionally the set torque and the nipping force between the separation roller 56 and the retard roller 57 cannot be adjusted in a correlative manner. Therefore, even when the frequency of the multi-transport of the sheet P is high, the structure has to be used as it is, it is necessary to stop reading for each of frequently occurring multi-transports of the sheet P, and an operation efficiency is largely deteriorated.

SUMMARY OF THE INVENTION

An object of the present invention is to provide a pressing force adjustable roller unit, and a transport system of a sheet member in an image processing apparatus provided with the roller unit.

Therefore, according to a first aspect of the present invention, there is provided a pressing force adjustable roller unit comprising: a roller; a holding shaft having a length projecting from an end surface of an axial direction of the roller and rotatably holding the roller; a torsion spring connected to the holding shaft in a direction that the holding shaft projecting from the end surface of the roller is pressed downward; and torsion torque change means for changing a torsion torque of the torsion spring.

With such a constitution, by changing the torsion torque of the torsion spring, the pressing force of the roller can be changed.

Moreover, a constitution in which the roller unit is disposed to form a nipping portion with a transport drive roller is applied to the image processing apparatus in which sheet members such as paper are transported, and in this case the pressing force suitable for transporting the sheet member can easily be set.

In the first aspect of the present invention, the roller unit may comprise a holder to which the holding shaft is rotatably attached and which is provided with a support shaft with a torsion spring winding portion attached to an outer periphery. The holder is provided with a long hole in which the holding shaft projecting from the end surface of the roller can move in a torsion direction of the torsion spring. Furthermore, the torque change means may be constituted of an engaging arm projecting from the torsion spring winding portion, and a plurality of stoppers formed on the holder, for engagingly stopping the engaging arm in a position for changing a wind-up degree of the winding portion. This has an effect that simply by changing a positional relation of the engaging arm to the stopper, the roller pressing force can be changed at the same number of steps as the number of stoppers.

Moreover, according to a second aspect of the present invention, there is provided a transport system of the sheet member in an image processing apparatus, in the image processing apparatus for performing image reading from sheet members such as paper or image formation on the sheet member based on input image information, in which the aforementioned roller unit is disposed in a transport path for transporting the sheet member, and a transport drive roller is disposed to form a nipping portion with a roller of the roller unit and is rotationally driven. The system has an effect that the applying of the pressing force suitable for transporting the sheet member to the sheet member can realize stable sheet member transport.

In the second aspect, the roller unit with a strengthened torsion torque of the torsion spring may be disposed immediately before and after an image reading section or an image forming section in the transport path, and with the roller unit, an effect of improving an image reading and forming precision can be obtained.

Moreover, an object of the present invention is to provide a sheet member supply system in which an optimum combination of a rotation torque of a retard roller, a nipping force between the retard roller and a separation roller and a hopper behavior can realize secure multi-transport prevention.

Thus, according to a third aspect of the present invention, there is provided a sheet member supply system comprising: a hopper on which sheet members such as paper are piled; a supply roller for picking up the sheet member and feeding out the sheet member to an image processing system; and a multi-transport preventing roller pair of a separation roller and a retard roller disposed on a downstream side of the supply roller and in an entrance to the image processing system, so that the hopper can vertically move with respect to the supply roller. This constitution further comprises multi-transport detection means, disposed on the immediate downstream side of the roller pair of the separation roller and the retard roller, for detecting multi-transport of the sheet member. This system is constituted so that, when the sheet member multi-transport is detected by the multi-transport detection means, the hopper is shifted in a downward direction apart from the supply roller, a nipping force between the separation roller and the retard roller is reduced and a rotation torque of the retard roller is increased.

With this constitution, even when the multi-transport of the sheet members such as paper cannot be prevented by the separation roller and retard roller, after the multi-transport detection, only an uppermost sheet member among multi-transported sheet members is transported to the image processing system, remaining sheet members can be returned to a hopper side by the retard roller, and secure multi-transport prevention can therefore be realized.

In the third aspect, the retard roller may be included in a retard motor driving system utilizing a DC motor whose output shaft rotation torque is variable in accordance with a current application amount. Thus, a simple constitution of controlling a power supply amount to a retard motor utilizing the DC motor can achieve an effect of changing the rotation torque of the retard roller and the supply of the sheet member and the prevention of multi-transport.

Moreover, an object of the present invention is to provide a sheet member supply system for adjusting a set torque of a retard roller and a nipping force between the retard roller and a separation roller to obtain an optimum multi-transport preventing condition in accordance with a sheet member or a multi-transport detection frequency so that secure multi-transport prevention can be performed.

Thus, according to a fourth aspect of the present invention, there is provided a sheet member supply system provided with a supply roller for picking up sheet members such as piled sheets and feeding out the sheet members to an image processing system, and a multi-transport preventing roller pair of a separation roller and a retard roller disposed on a downstream side of the supply roller and in an entrance to the image processing system. The supply system further comprises an automatic nipping force adjustment system for adjusting a nipping force between the separation roller and the retard roller, a set torque adjustment system for adjusting a critical set torque for rotating the retard roller in a forward rotation direction from a direction reverse to a supply direction of the sheet member, and a control system which can automatically adjust the nipping force by the automatic nipping force adjustment system and the set torque by the set torque adjustment system in accordance with material properties such as a sheet member friction coefficient.

With the constitution, since the nipping force between the separation roller and the retard roller and the set torque of the retard roller can automatically be set in accordance with the material properties such as the sheet member friction coefficient, it is possible to set optimum conditions for the transport of the sheet member, and the multi-transport of the sheet member is prevented. Moreover, when a control of reducing the nipping force to rotate/drive the retard roller in the sheet supply direction is included, a plurality of filed sheets can also be supplied, and diversification of sheet member types to be treated can be handled.

In the fourth aspect, the set torque adjustment system may use as a drive source a DC motor which is connected to the retard roller and whose output shaft rotation torque is variable in accordance with a current application amount. Thereby, with a simple constitution of controlling a power supply amount to a retard motor utilizing the DC motor, a function that the retard roller set torque is changed and the sheet member multi-transport can be prevented can be obtained.

Further, according to a fifth aspect of the present invention, there is provided a sheet member supply system comprising a supply roller for picking up sheet members such as piled sheets and feeding out the sheet members to an image processing system, a multi-transport preventing roller pair of a separation roller and a retard roller disposed on a downstream side of the supply roller and in an entrance to the image processing system, and multi-transport detection means disposed on an immediate downstream side of the roller pair, for detecting multi-transport of the sheet member. The supply system further comprises an automatic nipping force adjustment system for adjusting a nipping force between the separation roller and the retard roller, and a set torque adjustment system for adjusting a critical set torque for rotating the retard roller in a forward rotation direction from a direction reverse to a supply direction of the sheet member. With the constitution, it is controlled that the automatic nipping force adjustment system and set torque adjustment system adjust the nipping force and set torque to be suitable for sheet member properties in accordance with the number of multi-transports detected by the multi-transport detection means per sheet member unit number or unit time.

In this constitution, for example, it is assumed that several sets of sheet layers of different paper qualities are piled and supplied, multi-transport does not occur in the sheets of a certain paper quality, but, multi-transport frequently occurs when shifting to the sheet layer of another paper quality. At the time, since the nipping force and the retard roller set torque can be adjusted to be suitable for the paper quality in accordance with the detection of the number of multi-transports, the multi-transport can be prevented in a learning functional manner with respect to the sheet members such as sheets of various paper qualities.

In the fifth aspect, the set torque adjustment system may use as a drive source a DC motor which is connected to the retard roller and whose output shaft rotation number is variable in accordance with a current application amount. Thereby, with a simple constitution of controlling a power supply amount to a retard motor utilizing the DC motor, an effect is produced that the retard roller set torque is changed and the sheet member multi-transport can be prevented.

DETAILED DESCRIPTION OF THE PREFERRED EMBODIMENTS

An embodiment according to the present invention will be described hereinafter with reference to drawings. Additionally, in the present embodiment, an image scanner for reading an image from an original to form an electronic file will be described as an example.

Figure 1:
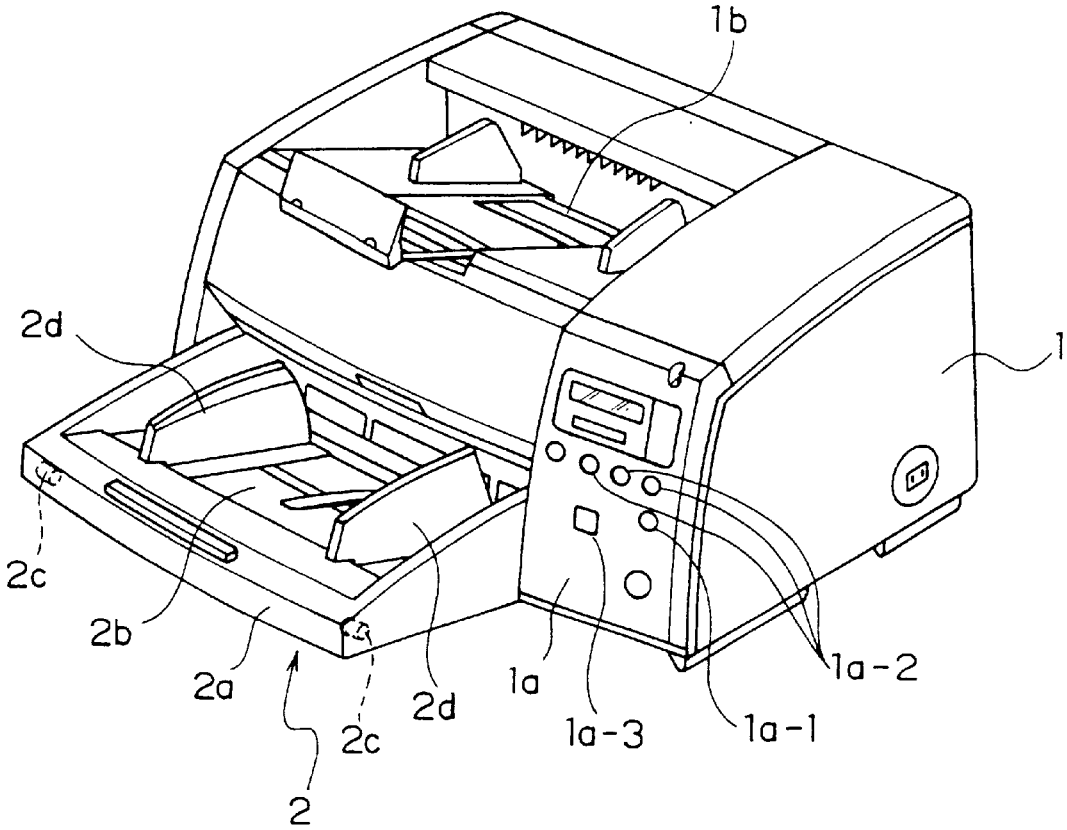
FIG. 1 is a schematic perspective view of an image scanner provided with a sheet member supply system according to the present invention.

FIG. 1 is a schematic perspective view of the image scanner provided with a sheet member supply system according to the present invention.

As shown in FIG. 1, the image scanner is constituted of a main body 1 in which an optical reading section and a sheet transport path are incorporated and an automatic sheet supply apparatus 2 as sheet supply means. The main body 1 has an operation panel 1*a* on its front surface and includes a controller (not shown) for controlling all apparatuses inside. Moreover, disposed on a top surface of the main body 1 is a collection tray 1*b* for receiving a sheet which is supplied from the automatic sheet supply apparatus 2 and whose image is completely read by the reading section.

Figure 2:
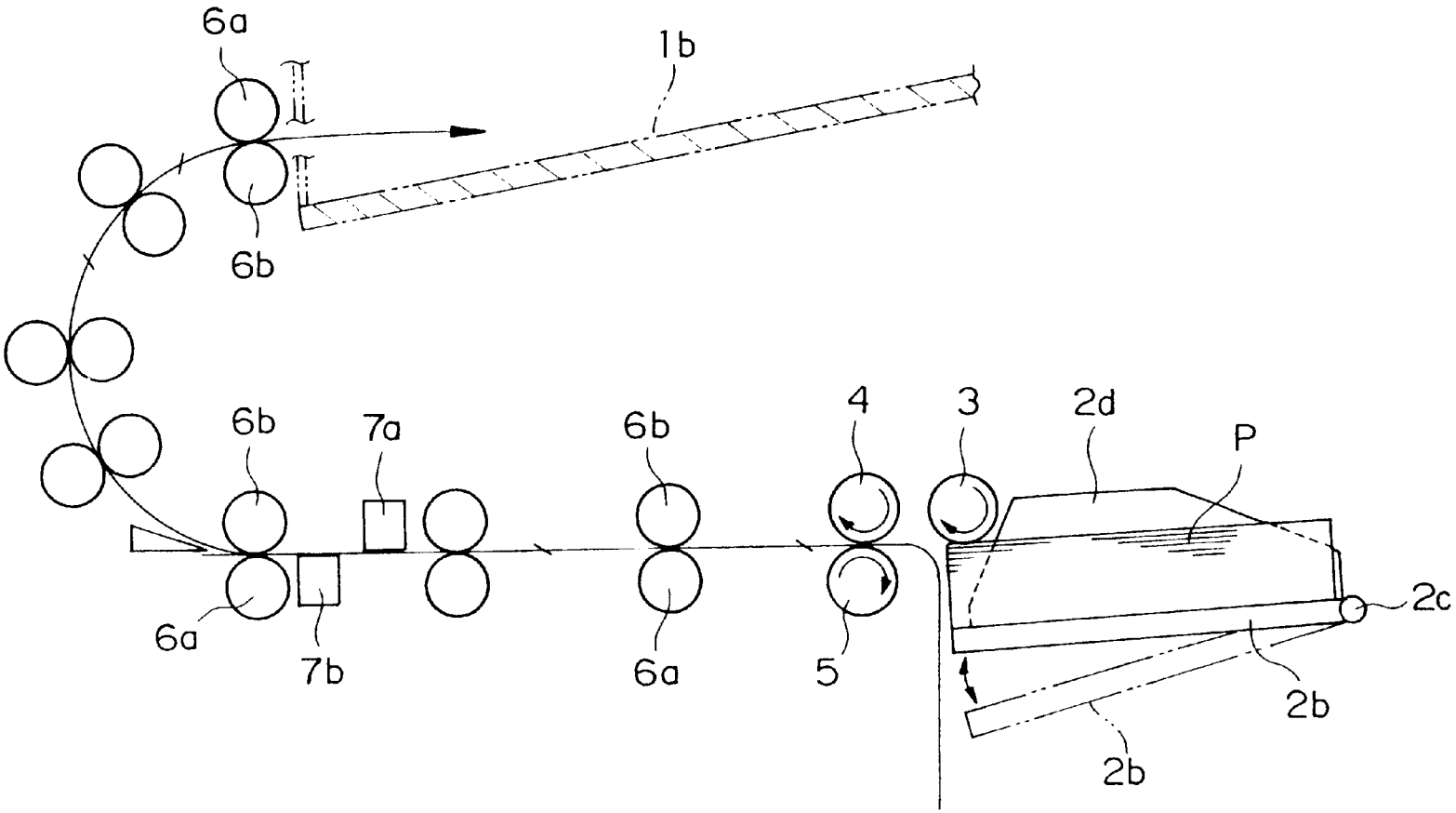
FIG. 2 is a schematic view from an automatic sheet supply apparatus hopper to a sheet transport path and a collection tray.

The automatic sheet supply apparatus 2 is provided with a hopper function for mounting a sheet and feeding out the sheet to a transport path in the main body 1 and a sheet multi-transport preventing function. FIG. 2 is a schematic view from a hopper in the automatic sheet supply apparatus to the sheet transport path and collection tray.

In the automatic sheet supply apparatus 2, a hopper 2*b* is vertically rotatably incorporated in a housing 2*a* via hinge pins 2*c*, and the hopper 2*b* is connected to an actuator (not shown) and driven to rotate around the hinge pins 2*c*. That is to say, sheets P piled on the hopper 2*b* are rotated and urged upward to obtain a posture for contacting a supply roller 3 which is fixed in a predetermined position above the hopper 2*b* and driven to rotate. Moreover, the top surface of the hopper 2*b* is provided with a pair of guides 2*d* which can manually be moved in an opening direction (a horizontal direction as seen from the front) to guide the sheet P in a width direction thereof.

On a downstream side of the supply roller 3 for picking up and feeding out the sheets P on the hopper 2*b* one by one, a pair of a separation roller 4 and a retard roller 5 for preventing multi-transport of the sheets P are disposed, and the transport path of the sheet P is formed between the roller pair and the collection tray 1*b*. In the transport path of the sheet P, a plurality of pairs of transport rollers 6*a*, 6*b* for nipping and transporting the sheet P are disposed, and a first scanning sensor 7*a* for reading an original image of the upper surface of the sheet P and a second scanning sensor 7*b* for reading the original image of the lower surface are disposed midway. Moreover, while one sheet P picked up from the hopper 2*b* by the supply roller 3 is passed through the transport path, the first and second scanning sensors 7*a*, 7*b* read the original images, and subsequently the sheet is discharged to the collection tray 1*b*.

Figure 3A:
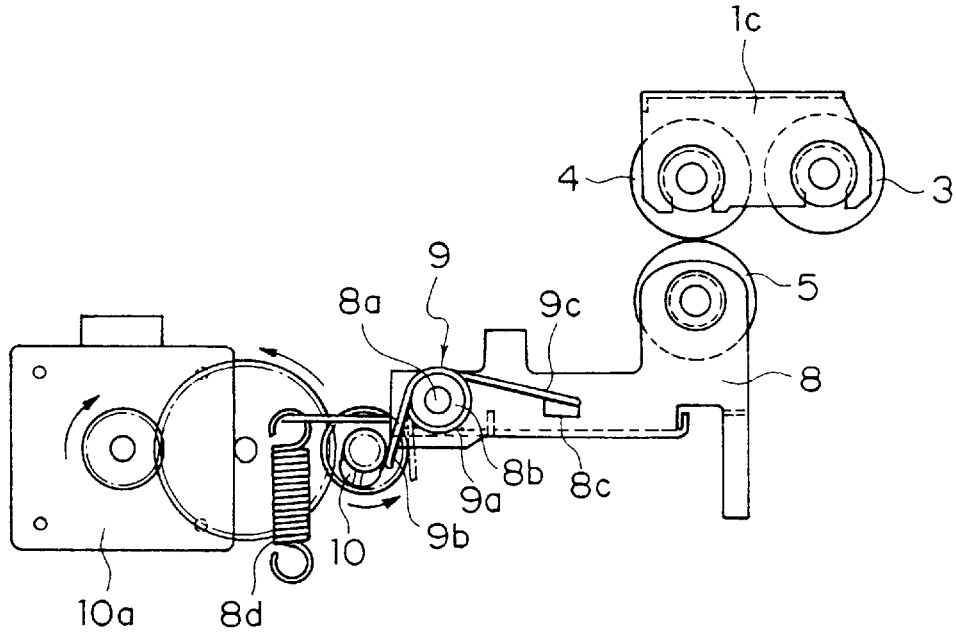
FIG. 3A is a side view showing a main part of a structure for incorporating a supply roller, separation roller and retard roller into a main body.
Figure 3B:
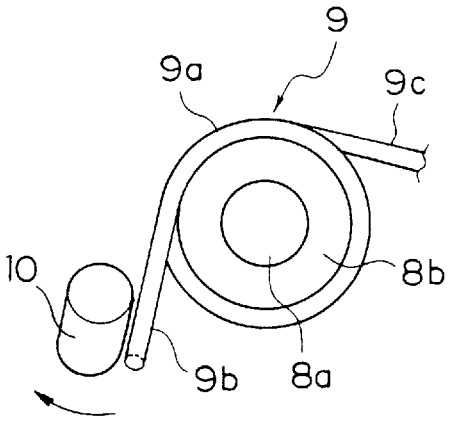
FIG. 3B is a schematic view showing a main part for adjusting an urging force of the retard roller.
Figure 3C:
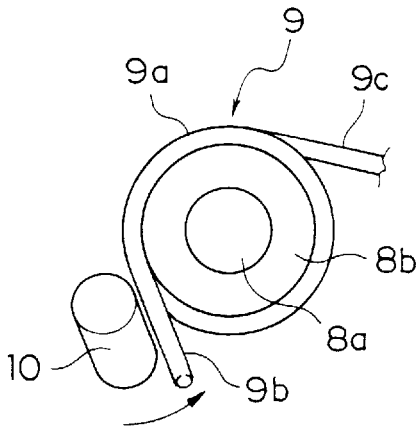
FIG. 3C is a schematic view showing the main part for adjusting the urging force of the retard roller.

FIG. 3A is a side view showing a main part of a structure for incorporating the supply roller 3, separation roller 4 and retard roller 5 into the main body 1, and FIGS. 3B and 3C are schematic views showing a main part for adjusting an urging force of the retard roller 5.

As shown in FIG. 3A, the supply roller 3 and separation roller 4 are rotatably attached to a frame 1*c* fixed to the main body 1. On the other hand, the retard roller 5 is attached to a base 8 which rotates around a support shaft 8*a* fixed in the main body 1. The base 8 is urged in a counterclockwise direction with respect to the support shaft 8*a* by a tensile spring 8*d* interposed between the base and the main body 1. A rotatable sleeve 8*b* is put on the support shaft 8*a* around the outer periphery, and a torsion spring 9 is wound around the sleeve 8*b*. As heretofore known, the torsion spring 9 is constituted of a winding portion 9*a* wound around the sleeve 8*b*, and an engaging arm 9*b* and an urging arm 9*c* which project from the winding portion in different directions from each other. The urging arm 9*c* is inserted and fitted into an engagement hole 8*c* made in the base 8, and the engaging arm 9*b* abuts on a peripheral surface of a cam 10 for adjusting an urging force.

The cam 10 is connected to a driving motor 10*a*, and driven to rotate, as shown in FIGS. 3B and 3C. In FIG. 3B, a bend degree of the engaging arm 9*b* by the cam 10 is small and a windup degree of the winding portion 9*a* is also small. Therefore, the urging force by which the urging arm 9*c* urges the base 8 upward is also small. On the other hand, when the cam 10 is rotated in an arrow direction as shown in FIG. 3C, the windup degree of the winding portion 9*a* becomes large, and the urging force to the base 8 by the urging arm 9*c* also becomes large accordingly.

When the driving motor 10*a* drives to rotate the cam 10 in this manner, the urging force of the torsion spring 9 can be changed. Therefore, a pressing force of the retard roller 5 to the separation roller 4 can be strengthened and weakened, and a nipping force with respect to the sheet P can arbitrarily be set.

Figure 4:
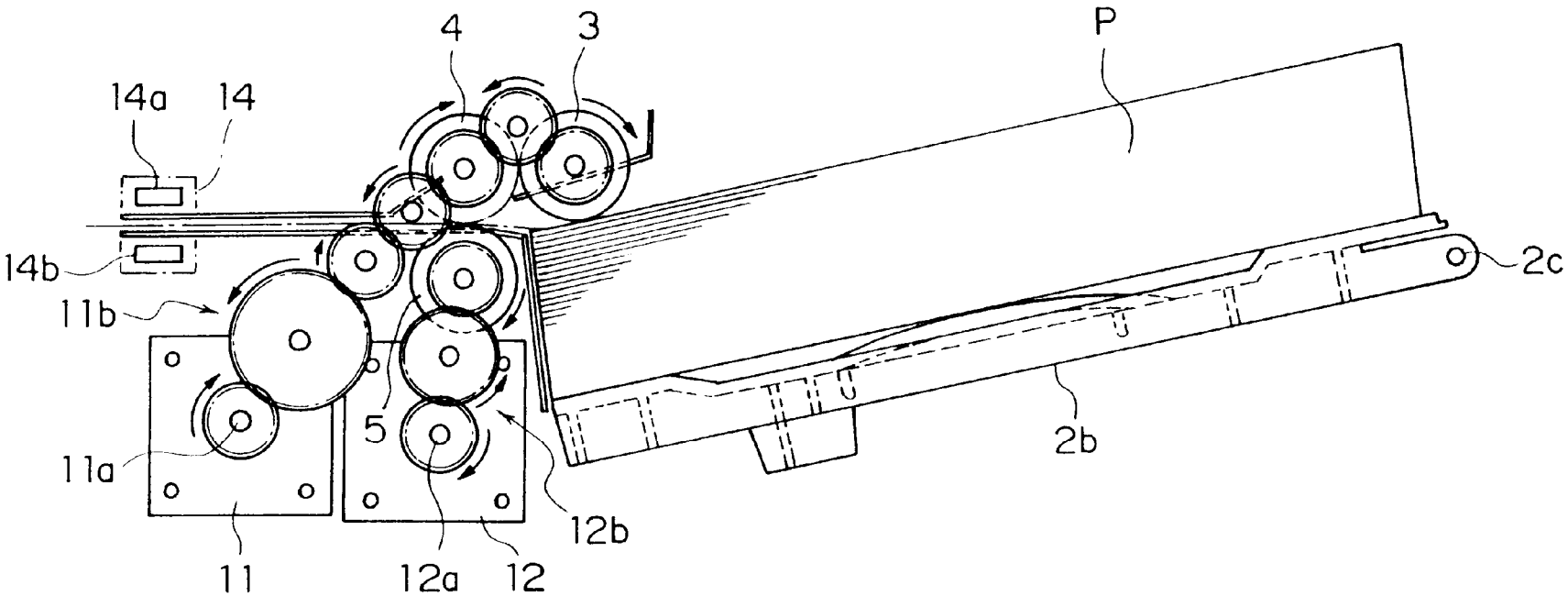
FIG. 4 is a side view showing a main part of the sheet member supply system according to the present invention.

FIG. 4 is a side view showing a main part of the sheet member supply system according to the present invention.

As shown in FIG. 4, the supply roller 3 and separation roller 4 are driven by a supply/separation motor 11 for common use in which a stepping motor is used, and the retard roller 5 is driven by a retard motor 12 in which a DC motor is used. An output shaft 11*a* of the supply/separation motor 11 and the separation roller 4, as well as the separation roller 4 and the supply roller 3, are connected to each other by a gear train 11*b*. Moreover, an output shaft 12*a* of the retard motor 12 is also connected to the retard roller 5 by a gear train 12*b*. When the sheet P is supplied, the respective rollers 3 to 5 are rotated in arrow directions in FIG. 4. That is to say, the supply roller 3 and separation roller 4 are rotated in a sheet supply direction of the sheet P, and the retard roller 5 is rotated in a direction reverse to the sheet supply direction. The output shafts 11*a*, 12*a* of the supply/separation motor 11 and retard motor 12 can be operated to rotate forward (rotation to the sheet supply direction) and backward by a controller (not shown) build in the main body 1. Moreover, the retard motor 12 using the DC motor can variably operate a rotation torque (rotation speed) by a power supply amount.

A multi-transport detection sensor 14 is disposed for detecting multi-transport of the sheet P on an immediate downstream side of the separation roller 4 and retard roller 5. The multi-transport detection sensor 14 utilizes an ultrasonic wave, and is constituted by combining an ultrasonic transmitter 14*a* and an ultrasonic receiver 14*b*. That is to say, the ultrasonic wave transmitted from the ultrasonic transmitter 14*a* is attenuated by an air layer between the multi-transported sheets P, and the multi-transport of the sheet P is detected in response to an output signal when the ultrasonic receiver 14*b* receives the attenuated ultrasonic wave. Additionally, instead of utilizing the ultrasonic wave, another multi-transport detection means may be used.

Figure 5:
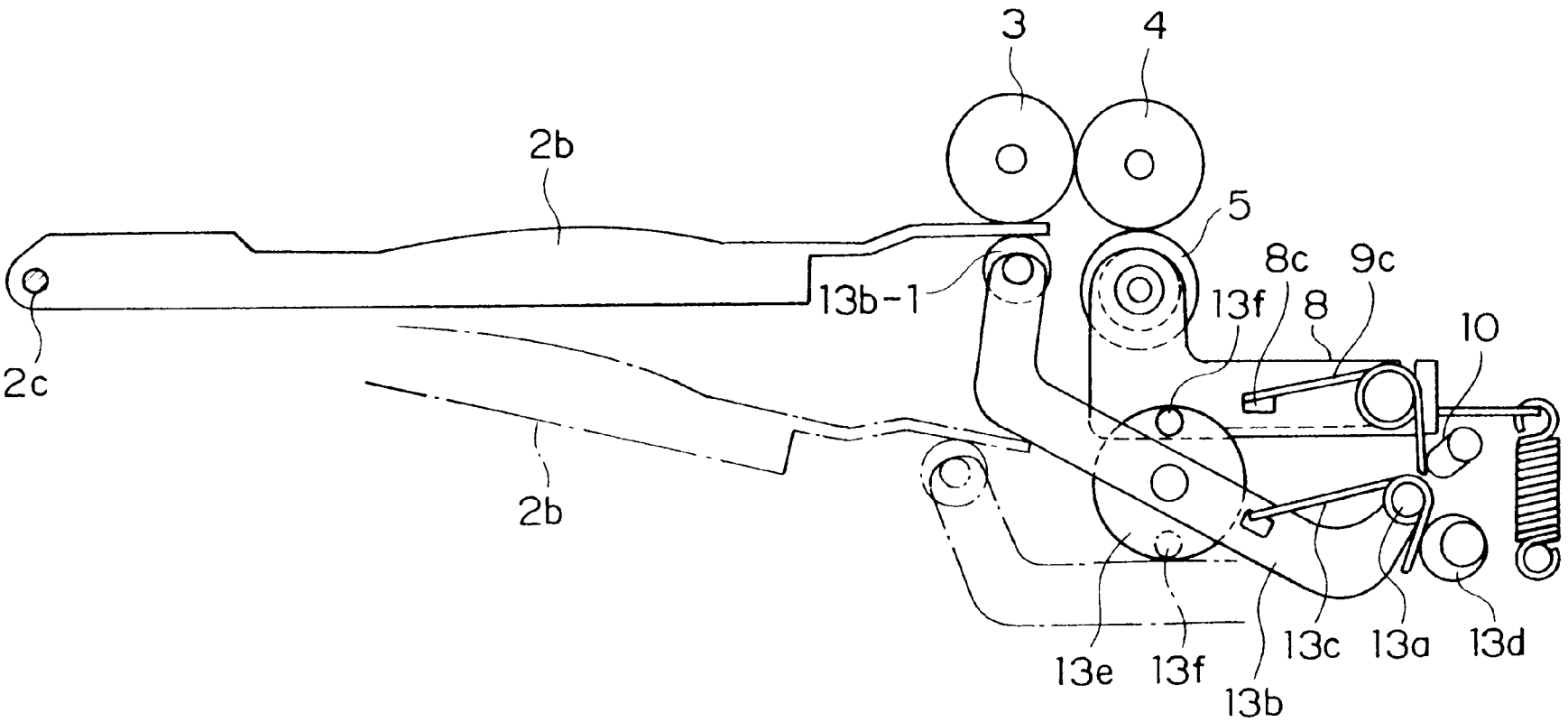
FIG. 5 is a schematic side view showing a main part of a system for a hopper tilting operation.

The hopper 2*b* can rotate around the hinge pin 2*c* as described above. FIG. 5 is a schematic side view showing a main part of a system for a hopper tilting operation.

In FIG. 5, a holding shaft 13*a* fixed in the main body 1 is connected to a pair of arms 13*b* at an interval in an axial direction (corresponding to an opening direction of the hopper 2*b*), and a torsion spring 13*c* put on the holding shaft 13*a* around the outer periphery urges the arm 13*b* upward. A tip end of the arm 13*b* is provided with a rotatable support roller 13*b*-1 for receiving the lower surface of the hopper 2*b*, and the torsion spring 13*c* is connected to an adjustment cam 13*d* which rotates in a manual operation. A gear 13*e* rotated by a driving motor (not shown) is disposed in the vicinity of the pair of the arms 13*b*, and a boss 13*f* projecting from the gear 13*e* engages with the upper surface of the arm 13*b*.

In such driving system, the boss 13*f* shown by a solid line in FIG. 5 is apart from the upper face of the arm 13*b*, and there is no downward restriction of the arm 13*b*. Therefore, the arm 13*b* rotates around the holding shaft 13*a* in a clockwise direction by the urging force of the torsion spring 13*c*, and allows a base end of the hopper 2*b* to contact the supply roller 3. On the other hand, when the driving motor rotates the gear 13*e*, the boss 13*f* abuts on the upper surface of the arm 13*b*, the arm 13*b* is pressed downward by the boss 13*f*, and the hopper 2*b* tilts downward around the hinge pin 2*c*. Moreover, when the boss 13*f* rotates and moves to the lowermost position, the hopper 2*b* takes a posture shown by a dashed line in FIG. 5.

Turning back to FIG. 4, the multi-transport detection sensor 14 for detecting the multi-transport of the sheet P is disposed on the immediate downstream side of the separation roller 4 and retard roller 5. The multi-transport detection sensor 14 utilizes the ultrasonic wave, and is constituted by combining the ultrasonic transmitter 14*a* and ultrasonic receiver 14*b*. That is to say, the ultrasonic wave transmitted from the ultrasonic transmitter 14*a* is attenuated by the air layer between the multi-transported sheets P, and the multi-transport of the sheet P is detected in response to the output signal when the ultrasonic receiver 14*b* receives the attenuated ultrasonic wave. Additionally, instead of utilizing the ultrasonic wave, another multi-transport detection means may be used.

In the aforementioned constitution, when an operation button 1*a*-1 (see FIG. 1) of the operation panel 1*a* is turned on, the supply/separation motor 11 and retard motor 12 are started, and the supply roller 3, separation roller 4 and retard roller 5 rotate in the respective arrow directions shown in FIG. 4. Moreover, the power supply amount to the retard motor 12 is set in such a manner that a friction force of the retard roller 5 with the sheet P forms a torque to act in the sheet supply direction when the separation roller 4 and retard roller 5 nip one sheet P. Thereby, when the supply roller 3 picks up the uppermost sheet P from the hopper 2*b*, this sheet is quickly transported, the original image is read by the first and second scanning sensors 7*a*, 7*b*, and subsequently the sheet is discharged to the collection tray 1*b*.

Here, the rotation torque of the retard motor 12 using the DC motor can arbitrarily be set by controlling the power supply amount. Therefore, by controlling the power supply amount to set the rotation torque in such a manner that the torque corresponds to the friction force acting between one sheet P and the retard roller 5 when the sheet is nipped between the retard roller and the separation roller 4, the retard roller 5 which usually rotates in the direction reverse to the sheet supply direction is rotated in the sheet supply direction. On the other hand, when two or more sheets P are picked up by the supply roller 3, the sheets P easily slip against each other and a load to the retard roller 5 is therefore reduced. Therefore, the retard roller 5 continues rotating in the arrow direction of FIG. 4, and the lower multi-transported sheet contacting the peripheral surface of the retard roller can be returned to a hopper 2*b* side.

As described above, when two or more sheets P are picked up, only the uppermost sheet P is fed and transported to the downstream side by rotation of the retard roller, the remaining lower sheets P are returned to the hopper 2*b* side and the multi-transport can be prevented by portions of the separation roller 4 and retard roller 5.

On the other hand, for example, when adhesion of the sheets P mounted on the hopper 2*b* to one another is high, multi-transport easily occurs, and the separation roller 4 and retard roller 5 sometimes fail to prevent the multi-transport as described above. The present invention is constituted to have a function of forcibly returning the unnecessary sheet to the hopper 2*b* side even when such a multi-transport occurs. This constitution will be described hereinafter.

Figure 6:
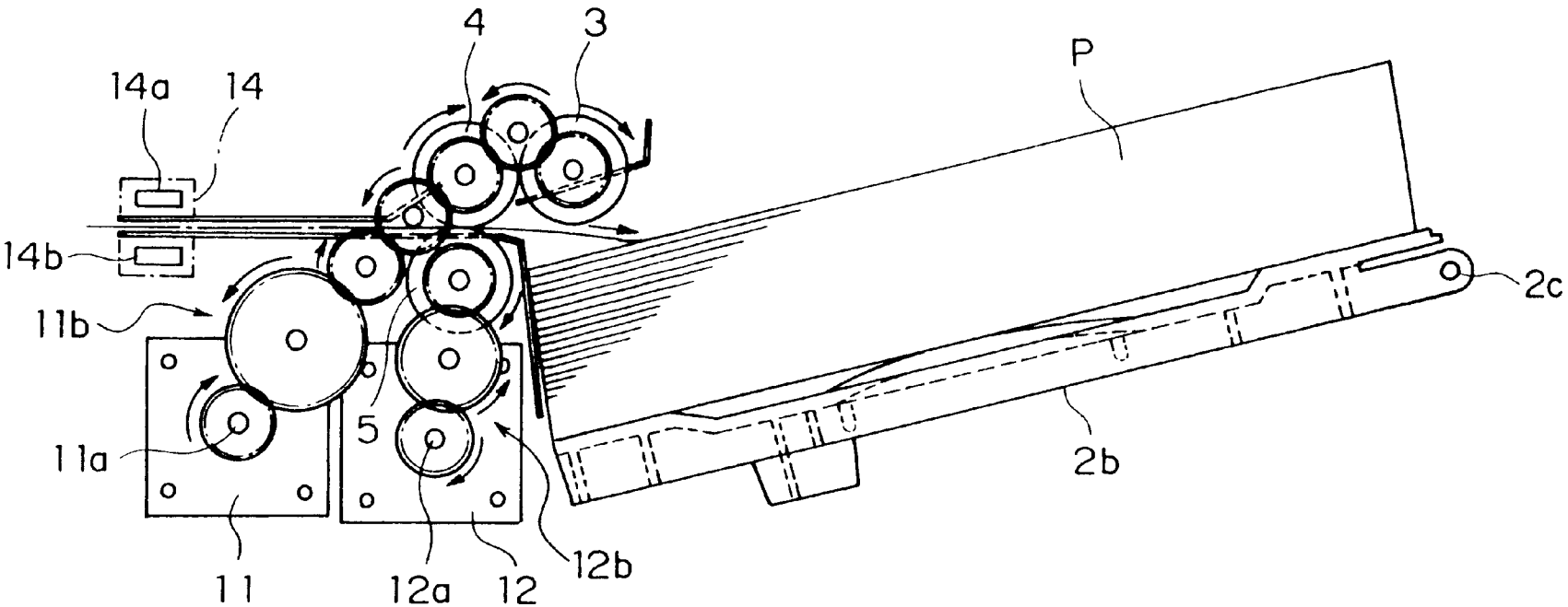
FIG. 6 is a side view showing a main part of the sheet member supply system during sheet multi-transport.

FIG. 6 is a side view showing a main part of the sheet member supply system during the sheet multi-transport.

After two or more sheets P are multi-transported and passed between the separation roller 4 and the retard roller 5, the multi-transported sheet P reaches the portion of the multi-transport detection sensor 14. Subsequently, the multi-transport detection sensor 14 detects the sheet multi-transport, a signal indicating this is inputted to a controller, then the hopper 2*b* is lowered as shown in FIG. 6, the pressing force between the retard roller 5 and the separation roller 4 is reduced, and the rotation torque of the retard roller 5 is further increased.

That is to say, an operation of lowering the hopper 2*b* is performed by rotating the gear 13*e* by the driving motor (not shown) as shown in FIG. 5 and setting the posture of the hopper 2*b* as shown by the dashed line. Moreover, in the usual case, as shown in FIG. 3C, the urging force of the torsion spring 9 is maintained to be strong as the posture of the cam 10, and the pressing force between the retard roller 5 and the separation roller 4 is set to correspond to the urging force. On the other hand, when the multi-transport detection sensor 14 detects the multi-transport, the driving motor 10*a* rotates the cam 10 to obtain the posture shown in FIG. 3B. This weakens the windup degree of the winding portion 9*a* of the torsion spring 9 and also reduces the urging force, and the pressing force between the retard roller 5 and the separation roller 4 is also reduced. Furthermore, when the power supply amount to the retard motor 12 is increased, the rotation torque of the retard roller 5 can be increased.

In such setting, since the hopper 2*b* lowers to detach the supply roller 3 from the upper surface of the piled sheet, the supply roller 3 has no relation with the two or more fed sheets P, and exerts no feeding force. Moreover, the pressing force between the retard roller 5 and the separation roller 4, that is, the nipping force to the multi-transported sheet is slightly released, but the rotation torque of the retard roller 5 is increased. Therefore, the uppermost sheet P contacting the separation roller 4 continues to be fed as it is, but the increase of the rotation torque of the retard roller 5 forces the remaining sheets P to return to the hopper 2*b* side as shown in FIG. 6.

As described above, even when the separation roller 4 and retard roller 5 cannot prevent the multi-transport of the sheets P, by the operation of the respective members after the multi-transport detection by the multi-transport detection sensor 14, the uppermost sheet P is supplied as it is and all the remaining sheets P can be returned to the hopper 2*b* side. Therefore, even in the image scanner for reading the original image from the sheets having various paper qualities and thickness values, the multi-transport is securely prevented and efficient reading operation can be performed.

Moreover, in the supply system in which the sheet P is picked up by the supply roller 3 and the separation roller 4 and retard roller 5 are disposed, when conditions are satisfied in accordance with various parameters, the sheet supply and the multi-transport prevention are possible with respect to one sheet. That is to say, when the respective pressing forces between the hopper 2*b* and the supply roller 3 and between the separation roller 4 and the retard roller 5 are adjusted, the sheet separating function by the separation roller 4 and retard roller 5 can be optimized. Conditions for such optimization will be described with reference to FIGS. 7A to 7C.

In the following condition equation, it is assumed that Pr is pressing force of the retard roller 5, T is set torque of the retard roller 5, r is a radius of the retard roller 5, and $\mu o$ is friction coefficient between the separation roller 4 and the retard roller 5. In this case, T, R, $\mu o$ denote constants.

Figure 7A:
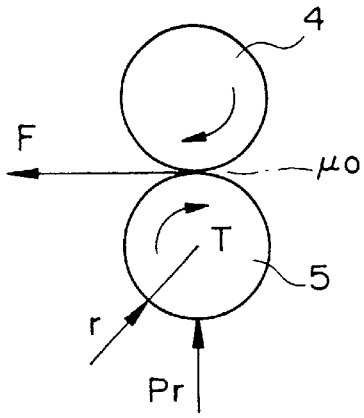
FIG. 7A is a diagram showing a relation between a pressing force of the separation roller and retard roller and a friction force.

(A) When there is not sheet P between the separation roller 4 and the retard roller 5, the retard roller 5 contacts the separation roller 4 to rotate together, that is, the rollers rotate in the counterclockwise direction reverse to the direction shown by the solid line in FIG. 7A. For the conditions, when a transport force by the contact of the separation roller 4 with the retard roller 5 is F, $F=\mu_0 \cdot Pr>T/r$. Therefore, the following formula (1) is obtained.

$$Pr>(1/\mu_0)\times(T/r) \tag{1}$$

(B) When there is only one sheet P between the separation roller 4 and the retard roller 5, there is no slippage between the separation roller 4 and the sheet P, a feed force is applied to the sheet P, simultaneously there is no slippage between the retard roller 5 and the sheet P, and the retard roller 5 rotates together with the separation roller 4 to feed the sheet P. For conditions, when a friction coefficient between the retard roller 5 and the sheet P is $\mu_2$, $\mu_2 \cdot Pr>T/r$. Therefore, the following formula (2) is obtained.

$$Pr>(1/\mu_2)\times(T/r) \tag{2}$$

Figure 7B:
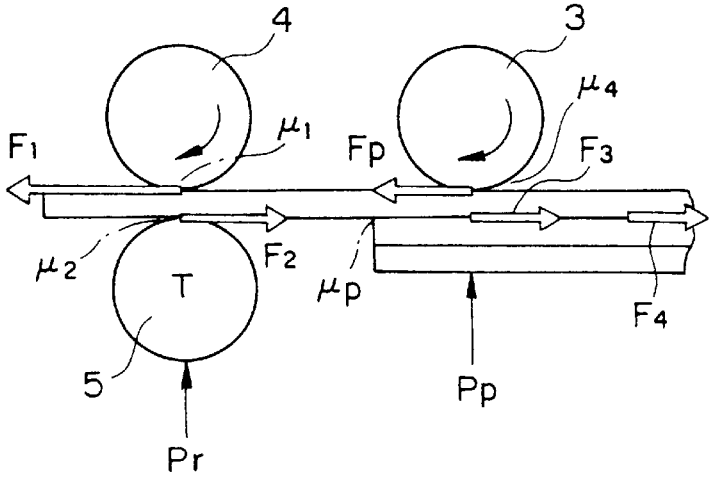
FIG. 7B is a diagram showing a relation of the friction forces when one sheet is supplied.
Figure 7C:
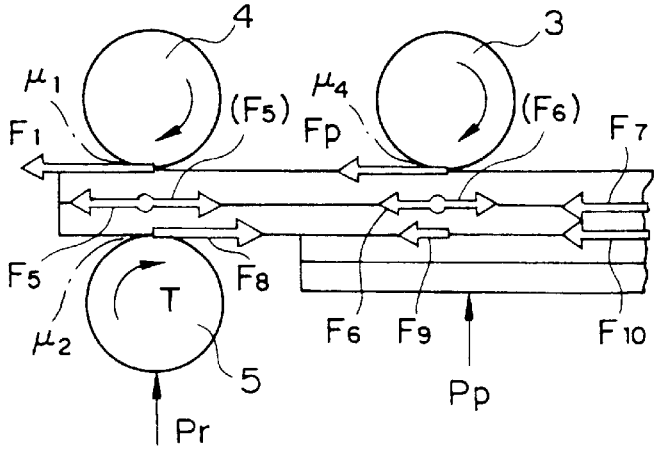
FIG. 7C is a diagram showing a relation of the friction forces during multi-transport of two sheets.

Moreover, when, as transport force conditions for allowing the separation roller 4 to transport the sheet P, $F_1$ is transport force of the separation roller 4, Fp is transport force of the supply roller 3, $F_2$ is return force of the retard roller 5, $F_3$ is friction force between the sheets P by the pressing force of the hopper 2*b*, and $F_4$ is friction force between the sheets P by weight of first sheet P, the following formula is obtained from FIG. 7B.

$$F_1+Fp>F_2+F_3+F_4$$

wherein, $\mu_1$: friction coefficient between the separation roller 4 and the sheet P;

$\mu_2$: friction coefficient between the retard roller 5 and the sheet P;

$\mu_4$: friction coefficient between the supply roller 3 and the sheet P;

$\mu p$: friction coefficient between the sheets P;

m: weight of one sheet P; and

Pp: pressing force of the hopper 2*b*, and the above inequality is rewritten as the following formula (3).

$$Pr>(1/\mu_1)\times(T/r)+(1/\mu_1)\times\{(\mu p-\mu_4)\times Pp+\mu p\times m\} \tag{3}$$

(C) When there are two sheets P between the separation roller 4 and the retard roller 5, the sheet P contacting the retard roller 5 is returned to the hopper 2*b* side by the retard roller against the friction force acting between the sheets P. For the conditions, when $F_5$ is friction force between the sheets P by the pressing force of the separation roller 4; $F_6$ is friction force between the sheets P by the pressing force of the hopper 2*b*; $F_7$ is friction force between the sheets P by the weight of the first sheet P; $F_8$ is return force of the retard roller 5; $F_9$ is friction force between the sheets P by the pressing force of the hopper 2*b*; and $F_{10}$ is friction force between the sheets P by weight of second and third sheets P, the following formula is obtained from FIG. 7C.

$$F_8>F_5+F_6+F_7+F_9+F_{10}$$

Moreover, when Pr, $\mu p$, Pp, M introduced in the formula (3) are used to rewrite this formula, the following formula (4) is obtained.

$$Pr<(1/\mu p)\times(T/r)-(2\times Pp+3\times m) \tag{4}$$

From the above respective condition formulas, for the pressing force Pr of the retard roller 5 to the separation roller 4, a larger value of the values of the formulas (1) and (2) is determined as a lower limit value. Moreover, since the formulas (3) and (4) are inequalities using Pr and Pp as variables, numeric values such as the set torque of the retard roller 5 and the friction coefficient of the sheet P for use are substituted in these formulas (3), (4) to determine a size relation between Pr and Pp.

In this manner, optimizing conditions for the sheet supply by the supply roller 3 and the sheet separation by the separation roller 4 and retard roller 5 can be represented by the pressing force Pr of the retard roller 5 and the pressing force Pp of the hopper 2*b*.

Figure 8:
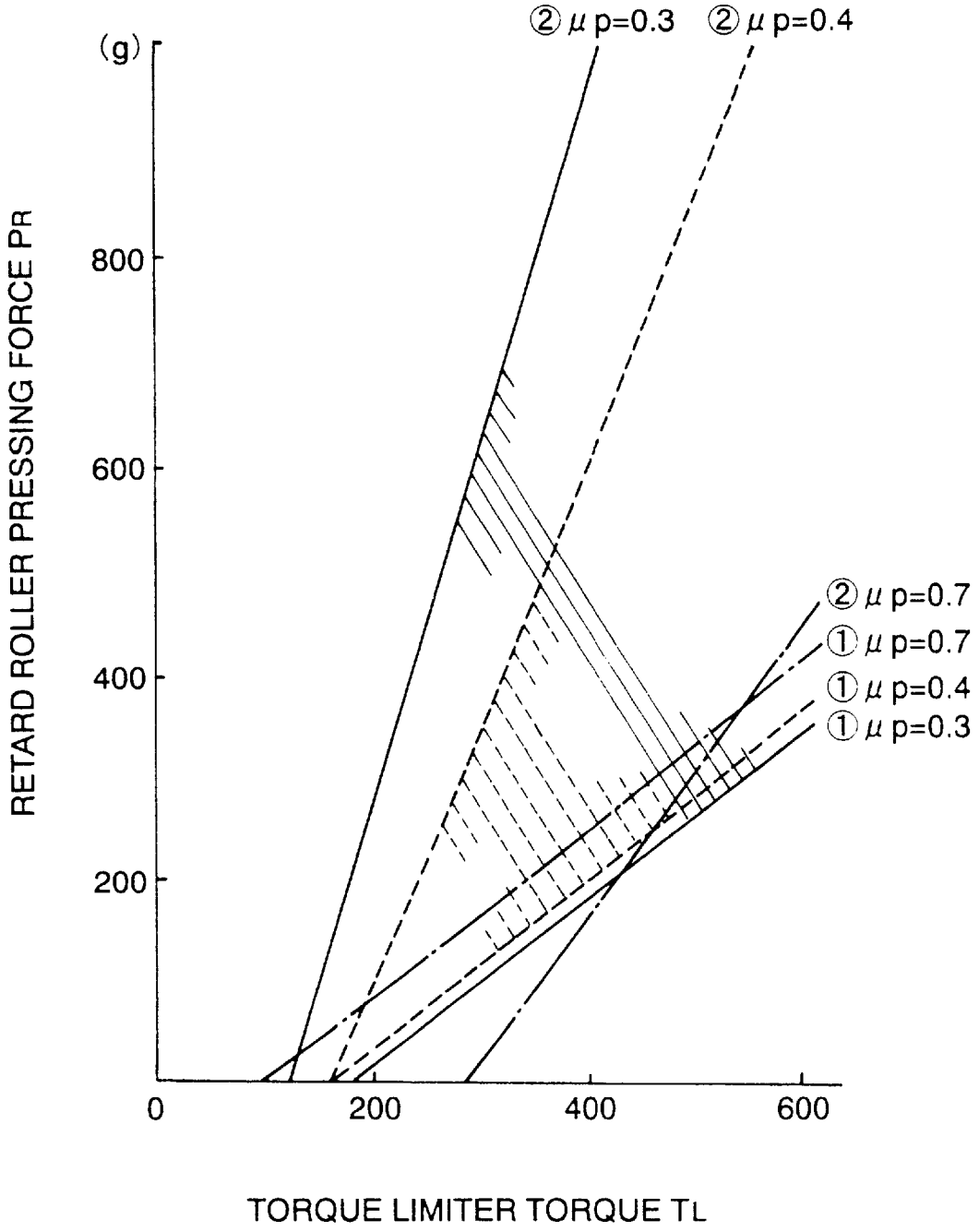
FIG. 8 is a graph showing a relation between a set torque of the retard roller and the pressing force to the retard roller.

Here, when r is 10 mm, $\mu_1$, $\mu_2$ and $\mu_4$ are 1.2, m is 3.99 g, we consider the cases that $\mu$p is 0.3, that $\mu$p is 0.4 and that $\mu$p is 0.7. In these cases, when by calculation of the formulas (3) and (4), a relation between the set torque T and pressing force Pr of the retard roller 5 is derived, a graph shown in FIG. 8 is obtained. Additionally, values of $\mu$p such as 0.3, 0.4, 0.7 are obtained by a difference in paper quality of the sheet P.

FIG. 8 is a graph showing the relation between the set torque of the retard roller and the pressing force to the retard roller. In FIG. 8, the relation between the set torque T and the pressing force Pr of the retard roller 5 with respect to the respective values of $\mu$p is appropriate in an area surrounded by ①, ② attached to the respective values from the formulas (3) and (4). Moreover, from this graph, an appropriate correlation of ranges of values of the set torque T and pressing force Pr of the retard roller 5 is found with respect to the value of the friction coefficient $\mu$p between the sheets P. Therefore, when the friction coefficient by the paper quality of the sheet P can substantially be estimated, the nipping force between the separation roller 4 and the retard roller 5 can be optimized by setting the rotation torque of the retard roller 5 in accordance with the power supply amount to the retard motor 12, and setting a rotation posture of the cam 10 by the driving motor 10*a*.

As described above, in the present invention, when the nipping force and the set torque of the retard roller 5 are adjusted beforehand in accordance with the paper quality and thickness of the sheet P, multi-transport can always be prevented regardless of the type of the sheet P. Moreover, even when only a front cover of a plurality of sheets such as slip filing is read, the nipping force between the separation roller 4 and the retard roller 5 is set to be small and further the retard roller 5 is driven in a forward direction, so that the filing can be supplied as it is without separating the plurality of sheets from one another.

On the other hand, a controller for controlling all operations is provided with a memory for storing data such as materials, friction coefficient ranges and thickness values for the respective types of the sheets P. The memory stores the data necessary for the respective types of sheets beforehand, and the corresponding data is outputted by turning on three select switches (see FIG. 1) for designating the type of the sheet P to be used. Moreover, these select switches 1*a*-2 correspond to the friction coefficient $\mu$p of the sheets P shown in FIG. 8, and the sheet is designated corresponding to $\mu$p=0.3 (coated paper), $\mu$p=0.4 (plain paper), $\mu$p=0.7 (bond paper). Additionally, in the shown example, four select switches 1*a*-2 are disposed so that one type sheet can be selected from four types of sheets, but one type sheet may be selected from a large number of types of sheets by increasing the number of switches.

Moreover, as shown in FIG. 1, the operation panel 1*a* is provided with a plural sheet mode switch 1*a*-3. When this plural sheet mode switch 1*a*-3 is turned on, the cam 10 is set to a posture in FIG. 3B by the driving motor 10*a*, and the output shaft 12*a* of the retard motor 12 is simultaneously driven to rotate in the counterclockwise direction in FIG. 4, so as to rotate the retard roller 5 in the sheet supply direction.

In the aforementioned constitution, when the select switch 1*a*-2 is turned on in accordance with the type of the sheet P to be used, the nipping force between the separation roller 4 and the retard roller 5 shown in FIG. 8, and the set torque of the retard roller 5 are automatically set. Therefore, the nipping force and the set torque of the retard roller 5 optimum for the type of the sheet P are obtained, and the multi-transport prevention of the sheet P is realized. That is to say, only by operating the select switch 1*a*-2 in accordance with the type of the sheet P on a user side, the optimum separating conditions are obtained for the sheet P, and the multi-transport of the sheet P can securely be prevented.

Moreover, when the plural sheet mode switch 1*a*-3 is turned on, the nipping force is weakened, and simultaneously the retard roller 5 is driven to rotate in the sheet supply direction. Therefore, the plurality of sheets can be passed as it is without separating the plurality of sheets of a filing-shpae from one another, and only the image of the front cover can be read.

As described above, in the present invention, the adjustment of the nipping force by the cam 10 and the change of the set torque by the control of the power supply amount to the retard motor 12 using the DC motor can automatically be performed according to the type of the sheet P, and the plurality of sheets can also be handled. Therefore, the present invention can most appropriately be utilized in the image scanner for reading various originals, and efficient image reading is possible without causing the multi-transport.

On the other hand, for the sheet P passed through the separation roller 4 and retard roller 5, the multi-transport detection sensor 14 detects whether one sheet P is transported or two or more sheets P are multi-transported. When it is detected that the sheet P is in a multi-transport state, the sheet supply is stopped by the controller and the multi-transported sheet P is manually drawn out. Alternatively, by temporarily setting the nipping force between the separation roller 4 and the retard roller 5 to be slightly smaller and further increasing the power supply amount to the retard motor 12 to increase the rotation torque of the retard roller 5, the sheet P is forcibly pushed back to the hopper 2*b* side. Furthermore, in the present invention, the number of multi-transports of the sheets P per unit time is detected, and the rotation torque of the retard roller 5 and the nipping force between the retard roller 5 and the separation roller 4 are automatically and finely adjusted in accordance with the frequency of multi-transport, to prevent the multi-transport of the sheet P in a learning functional manner.

Figure 9:
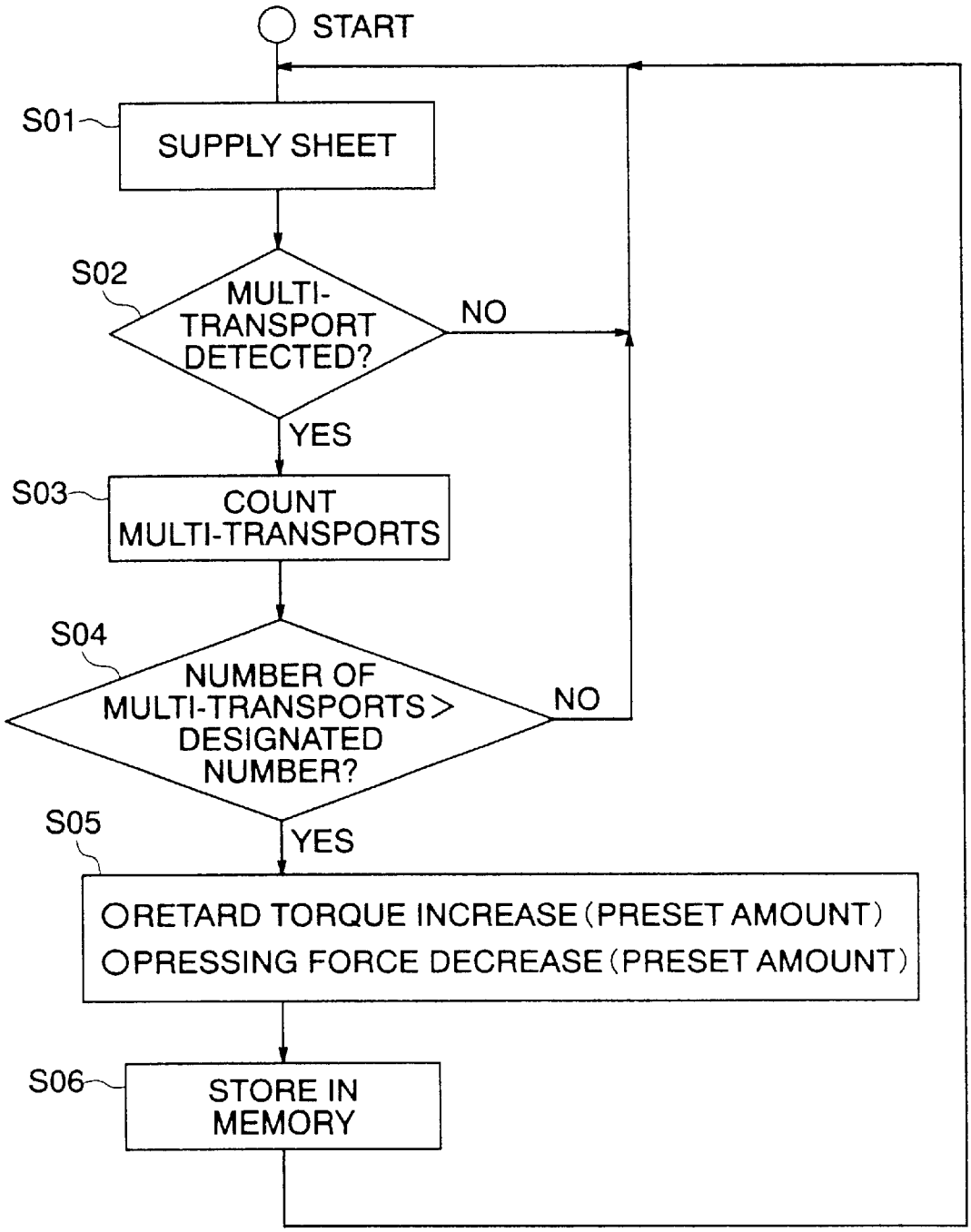
FIG. 9 is a control flowchart of the sheet member supply system in the present invention.

FIG. 9 is a control flowchart of the sheet member supply system according to the present invention.

As shown in the flowchart of FIG. 9, when the sheet P is supplied (S01), the multi-transport detection sensor 14 detects the multi-transport (S02), and counts the number of multi-transports (S03). When the detected number of multi-transports per unit time or the number of fed sheets P (e.g., 100 to 500 sheets) is n (n=1, 2, . . . ), the rotation torque of the retard roller 5 and the pressing force of the retard roller 5 by the cam 10, that is, the nipping force between the retard roller and the separation roller 4 are adjusted in accordance with the detected number. In this operation, when the supply of the sheet P is started, the rotation torque and nipping force are initially set. However, when the multi-transport is detected once after the start, setting is not changed. When the detected time gradually increases to twice or third, it is judged that the rotation torque and nipping force do not match the sheet and the setting is changed (S04, S05). Moreover, when the multi-transport does not occur for the unit time or the number of supplied sheets by changing the setting in such the manner, the setting is stored in a memory (S06) as completion of matching and the sheet supply is continued as it is. Furthermore, when the multi-transport further occurs even after the changing of the setting and the number of occurrences exceeds a designated number, the setting is changed again. Subsequently, the similar operation is performed, and the rotation torque of the retard roller 5 and the nipping force between the retard roller and the separation roller 4 are adjusted in the learning functional manner until the multi-transport of the sheet P does not occur.

As described above, the multi-transport detection sensor 14 detects the multi-transport of the sheet P, and the rotation torque and nipping force of the retard roller 5 are adjusted in accordance with the number of detected multi-transports and matched. Therefore, in the sheets P mounted on the hopper 2*b*, for example, the friction coefficient of an upper layer is small and the friction coefficient of a lower layer is large. Even when the sheet types in the sheets differ in this manner, the multi-transport can be prevented from occurring by the matching adjustment.

Another embodiment according to the present invention will next be described with reference to the drawings.

Figure 10:
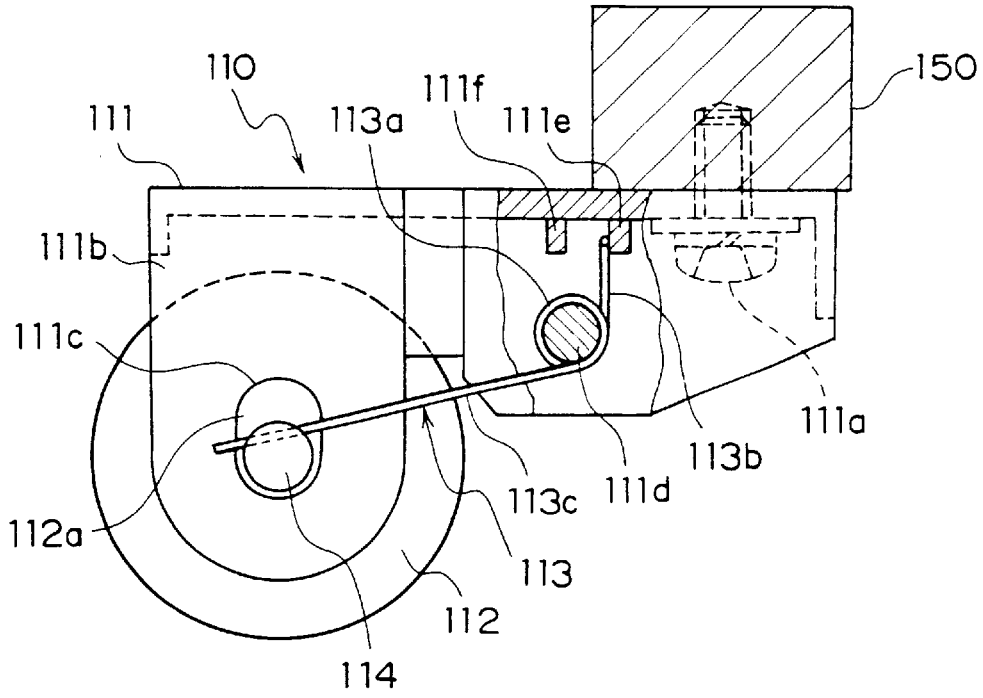
FIG. 10 is a partially cut right side view of a roller unit according to the present invention.
Figure 11:
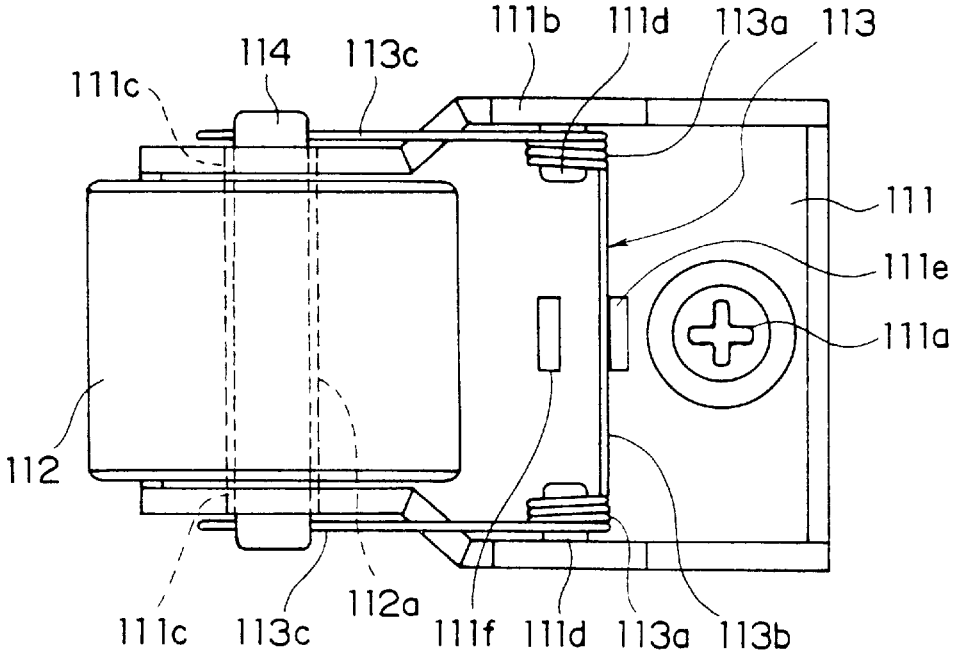
FIG. 11 is a bottom view of the roller unit in FIG. 10.
Figure 12A:
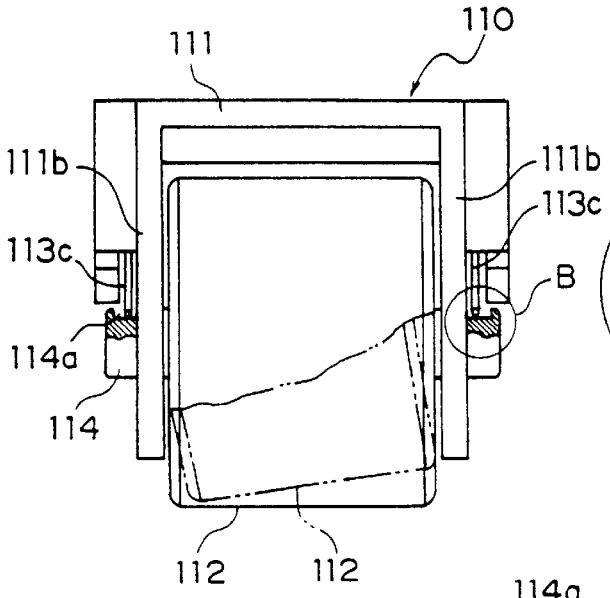
FIG. 12A is a front view of the roller unit in FIG. 10.
Figure 12B:
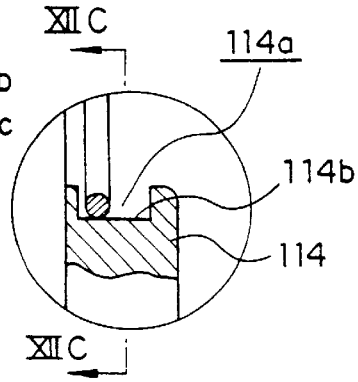
FIG. 12B is a partial enlarged view of B portion in FIG. 12A.
Figure 12C:
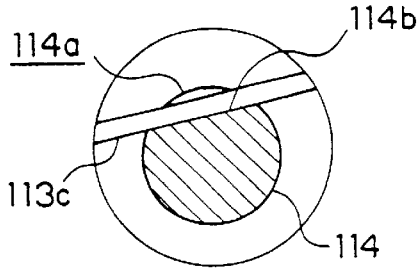
FIG. 12C is a sectional view taken along a line XIIC—XIIC in FIG. 12B.
Figure 13:
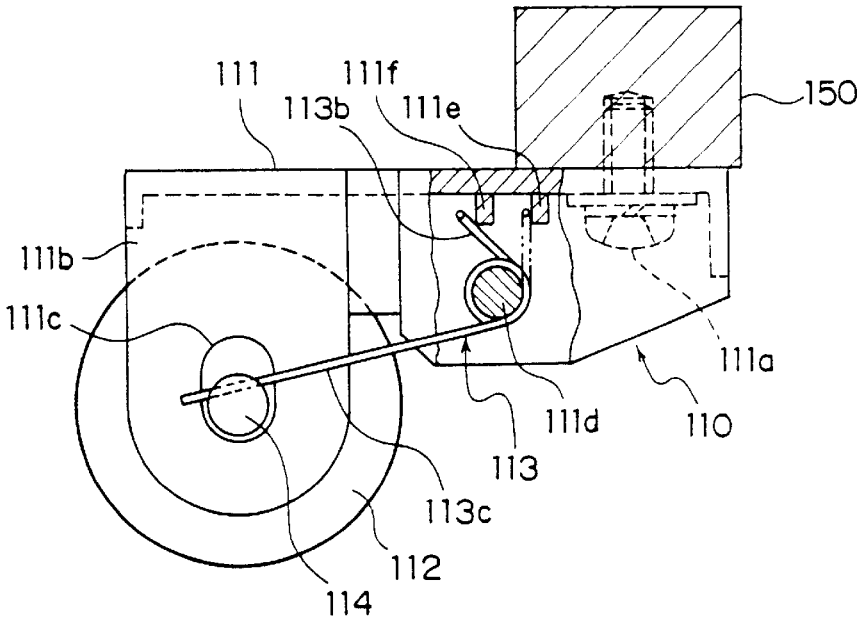
FIG. 13 is a partially cut right side view of the roller unit when an urging force of a torsion spring is strengthened.

FIGS. 10 to 13 show details of a roller unit in the present embodiment, FIG. 10 is a partially cut right side view of the roller unit according to the present invention, FIG. 11 is a bottom view of the roller unit in FIG. 10, FIG. 12 is a front view of the roller unit in FIG. 10, and FIG. 13 is a partially cut right side view of the roller unit when an urging force of a torsion spring is strengthened.

In FIGS. 10 to 13, a roller unit 110 includes, as main members, a holder 111 fixed to a frame 150 of each apparatus by a screw 111*a*, a roller 112 rotatably supported by the holder 111, and a torsion spring 113 for urging the roller 112 downward in FIG. 10.

A pair of brackets 111*b* project downward from the holder 111. This bracket 111*b* is provided with a long hole 111*c* having a long axis in an attached portion of the roller 112 in a vertical direction, and a pair of support shafts 111*d* for supporting the torsion spring 113 are disposed on an inner wall in the vicinity of the screw 111*a*.

The roller 112 is constituted by making a through hole 112*a* in an axial direction and inserting a holding shaft 114 into the through hole 112*a*. The holding shaft 114 has a circular section, rotatably holds the roller 112 around its periphery, and is connected to the holder 111 by inserting both ends into the long hole 111*c* of the bracket 111*b*. Additionally, the roller 112 and holding shaft 114 are in an assembled structure for restricting each other to obtain a positional relation in an axial direction shown in FIGS. 11, 12A, 12B, 12C, that is, a relation such that both ends of the holding shaft 114 project by the same length from both ends of the roller 112. Moreover, even with such restriction, the roller 112 can lightly rotate around the holding shaft 114 passed through the through hole 112*a*.

In the holding shaft 114, as shown in FIG. 12A, an engagement groove 114*a* is formed in a part of a peripheral surface on each end. The torsion spring 113 can be fitted/held in these engagement grooves 114*a*. As shown in an enlarged cut view 12B of a portion surrounded by a circle B in FIG. 12A, the engagement groove 114*a* has a concave section, and as shown in an enlarged sectional view 12C taken along a line XIIC—XIIC in the enlarged cut view of FIG. 12B, the torsion spring 113 covers the groove from above.

As shown in FIG. 10, the torsion spring 113 is constituted of a pair of winding portions 113*a* put on the support shafts 111*d* around the periphery, an engaging arm 113*b* for connecting these winding portions 113*a* to each other, and urging arms 113*c* extended from the winding portions 113*a* toward the roller 112. As shown in FIGS. 12A to 12C, the urging arm 113*c* enters the engagement groove 114*a* of the holding shaft 114, and elastically urges the holding shaft 114 downward. In this case, as shown in the enlarged view 12C of FIG. 12A, the urging arm 113*c* pushes a flat pressing surface 114*b* of the engagement groove 114*a*, and therefore regulates rotation of the holding shaft 114. Moreover, the holding shaft 114 is loosely inserted into the long hole 111*c* of the bracket 111*b*. Therefore, when a load is applied upward from below, the holding shaft pushes up the urging arm 113*c* against the urging force of the arm, and this restoring reaction force of the urging arm 113*c* acts as the pressing force of the roller 112.

The pressing force of the roller 112 is substantially proportional to a torsion torque of the torsion spring 113, and thus, the pressing force of the roller 112 can be adjusted by changing this torsion torque. Therefore, in the present invention, in order to change a bend degree of the engaging arm 113*b* of the torsion spring 113 and thereby switch the torsion torque in two steps, as shown in FIGS. 10 and 11, a first stopper 111*e* and a second stopper 111*f* are disposed on the lower surface of the holder 111. These first and second stoppers 111*e*, 111*f* are projections disposed parallel to each other at an interval, and in FIG. 10 the engaging arm 113*b* of the torsion spring 113 engages with the first stopper 111*e*.

In the aforementioned constitution, the holder 111 fixed to the frame 150 as a fixing point by the screw 111*a* is also held in a posture of FIG. 10 in a fixed state. Moreover, when the roller 112 abuts onto a sheet member surface of the like, the restoring force of the torsion spring 113 corresponding to the abutting force acts as the pressing force onto the sheet member. In this case, the urging arm 113*c* of the torsion spring 113 enters the engagement groove 114*a* of the holding shaft 114, and has a degree of freedom to such an extent that the arm can horizontally move in the engagement groove 114*a* as shown in the enlarged view 12B of the portion surrounded with the circle B of FIG. 12A. Therefore, when the sheet member is not parallel to the axial line of the holding shaft 114 in FIG. 12A, and forms, for example, a rightward ascending flat surface, as shown by a dashed line in FIG. 12A, the roller 112 can move to be tilted and displaced upward. That is to say, the roller 112 can change its posture and press the sheet member with a certain degree of freedom not only in a vertical direction crossing at right angles to the axial line but also in an oblique direction.

Here, the torsion torque of the torsion spring 113 changes by a windup degree of the winding portion 113*a*. That is to say, instead of allowing the engaging arm 113*b* to engage with the first stopper 111*e*, when the engaging arm 113*b* engages with the second stopper 111*f* as shown in FIG. 13, the windup degree of the pair of winding portions 113*a* increases. Therefore, the torsion torque of the torsion spring 113 also increases, and a force of the urging arm 113*c* for pressing the holding shaft 114 downward also becomes strong. Therefore, the pressing force of the roller 112 onto the sheet member also increases.

In this manner, by choosing which of the first stopper 111*e* or the second stopper 111*f* to be engaged with by the engaging arm 113*b* of the torsion spring 113 for urging the holding shaft 114 downward, the pressing force of the roller 112 to the sheet member can be changed. Therefore, when the roller unit 110 is incorporated into a sheet transport path of a copying machine or another image processing apparatus, it is possible to change the pressing force in two ways in sheet feeding.

Figure 14:
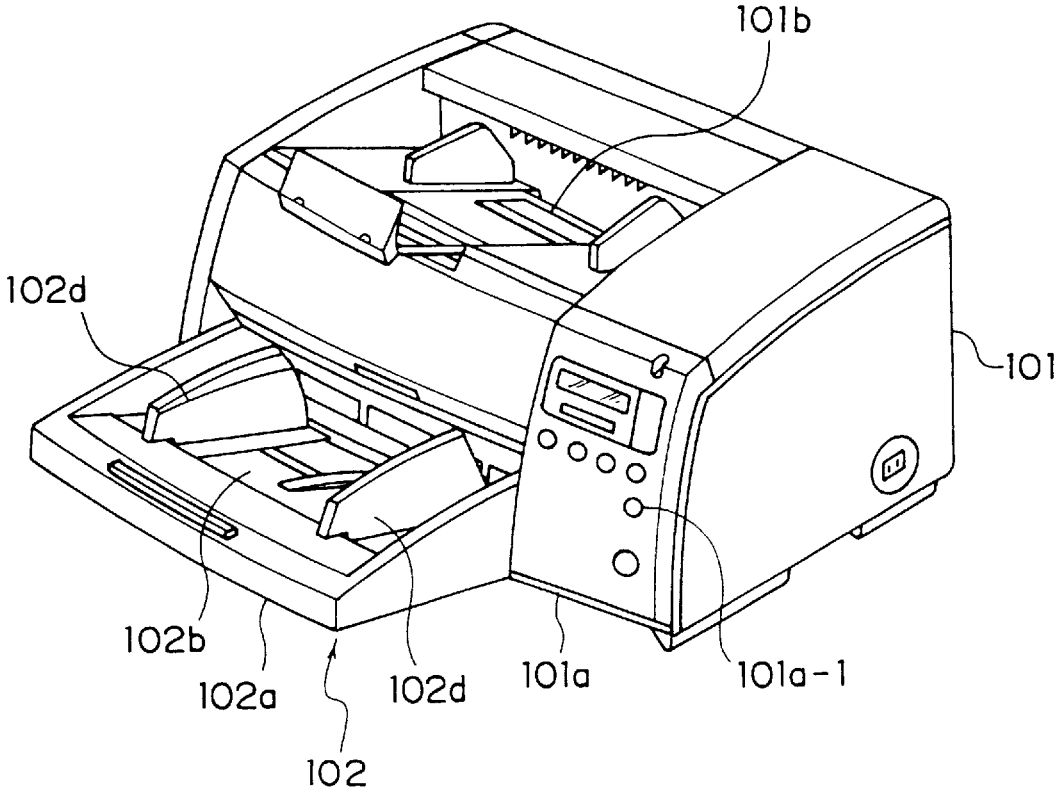
FIG. 14 is a schematic perspective view of the image scanner provided with the sheet member supply system according to the present invention.

FIG. 14 is a schematic perspective view of the image scanner provided with the sheet member transport system according to the present invention. In this embodiment, an image scanner for reading an image from an original to form an electronic file will be described as an example.

As shown in FIG. 14, the image scanner is constituted of a main body 101 including an optical reading section and a sheet transport path, and an automatic sheet supply apparatus 102 as sheet supply means. The main body 101 has an operation panel 101*a* on its front surface and includes a controller (not shown) for controlling all apparatuses inside. Moreover, disposed on a top surface of the main body 101 is a collection tray 101*b* for receiving a sheet which is supplied from the automatic sheet supply apparatus 102 and whose image is completely read by the reading section.

Figure 15:
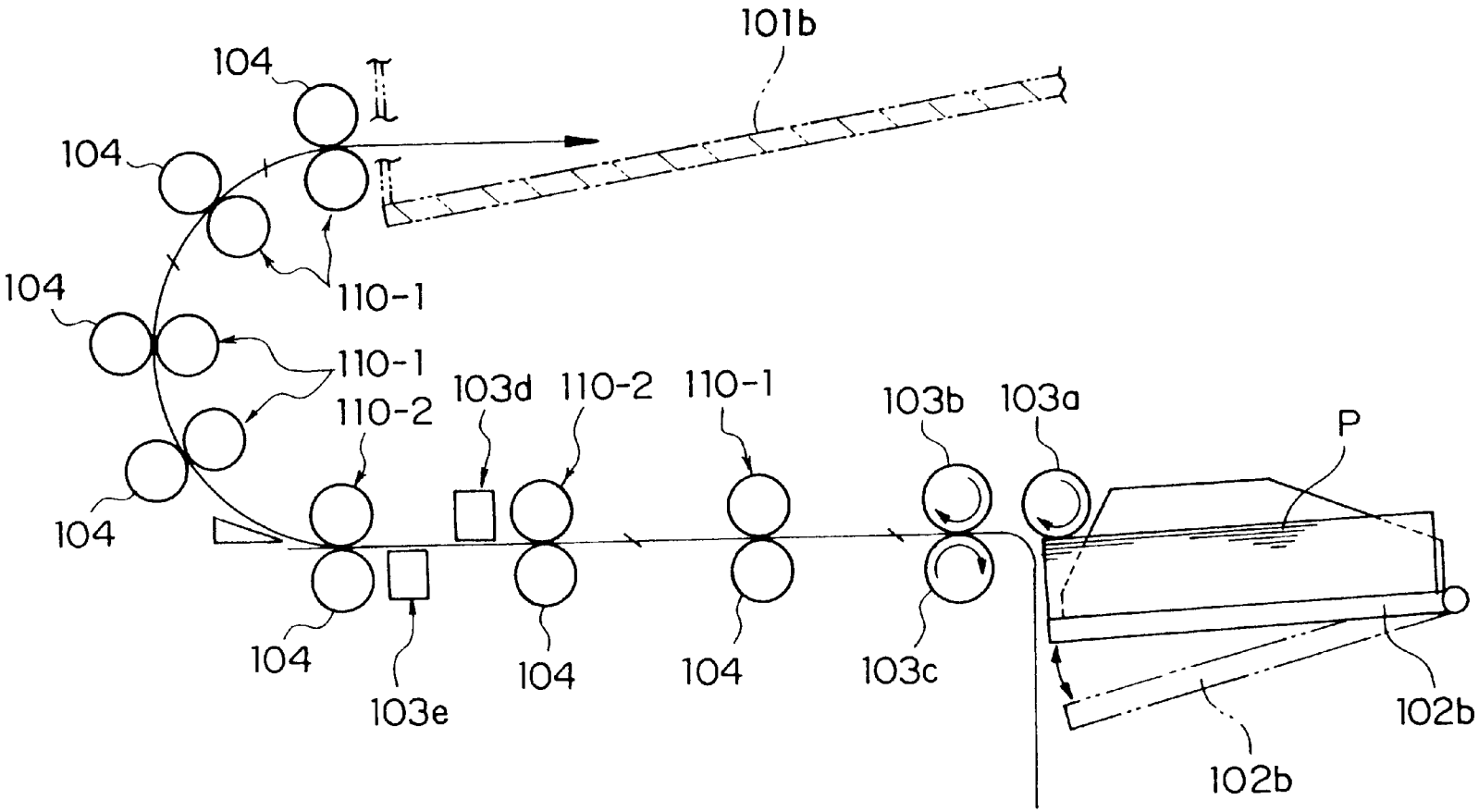
FIG. 15 is a schematic view from the automatic sheet supply apparatus hopper to the sheet transport path and collection tray.
Figure 16:
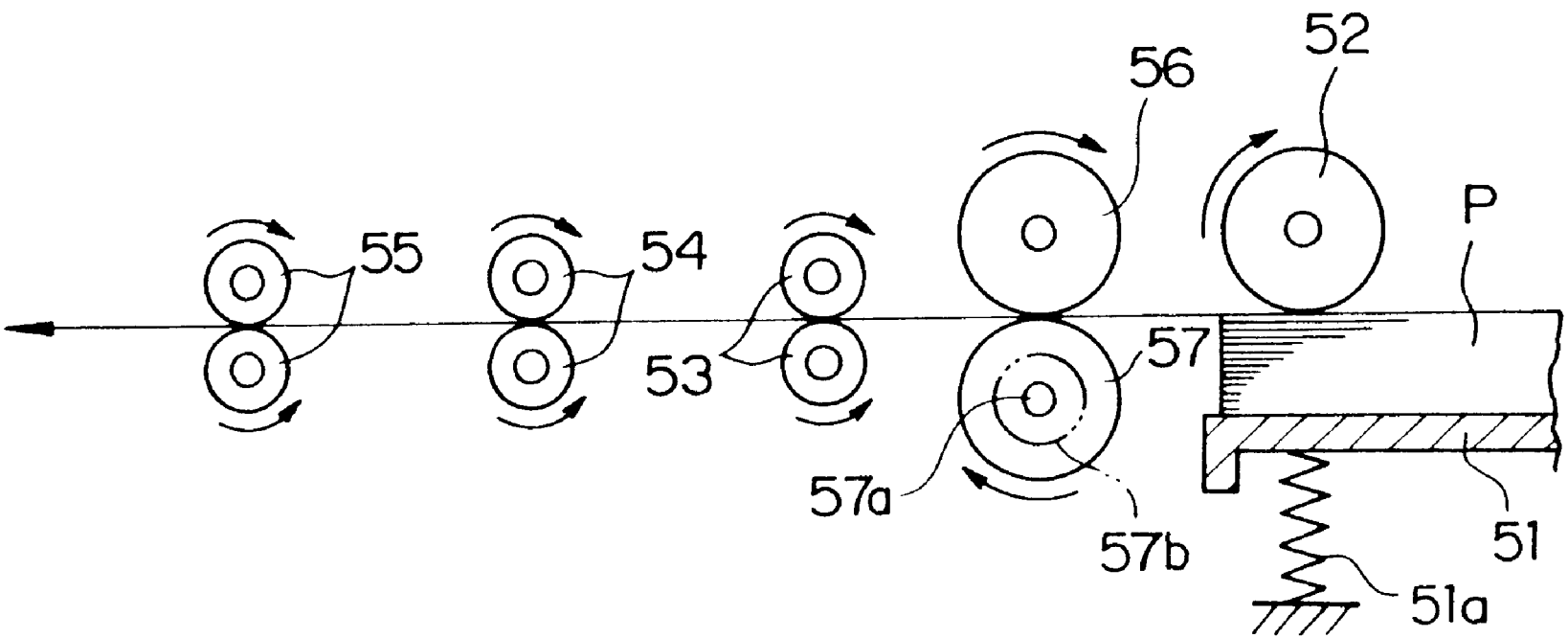
FIG. 16 is a schematic view showing a typical example of a sheet supply apparatus provided with a conventional multi-transport prevention system.

The automatic sheet supply apparatus 102 is provided with a hopper function for mounting a sheet and feeding out the sheet to the transport path in the main body 101 and a sheet multi-transport preventing function. FIG. 15 is a schematic view from the hopper of an automatic sheet supply apparatus to the sheet transport path and collection tray.

In the automatic sheet supply apparatus 102, a hopper 102*b* is vertically rotatably incorporated in a housing 102*a*, and the hopper 102*b* is connected to and driven by a motor (not shown). When supplying the sheet, as shown in FIG. 15, the hopper 102*b* is urged to rotate upward to obtain a posture that the sheet P is brought into contact with a supply roller 103*a*. Moreover, the hopper 102*b* is provided at the top surface with a pair of guides 102*d* which can manually be moved in an opening direction (a horizontal direction as seen from a front surface) to guide the sheet P in a width direction.

On a downstream side of the supply roller 103*a* for picking up and feeding out the sheets P on the hopper 102*b* one by one, a pair of a separation roller 103*b* and a retard roller 103*c* for preventing multi-transport of the sheets P are disposed, and the transport path of the sheet P is formed between the roller pair and the collection tray 111*b*. In the transport path of the sheet P, a first scanning sensor 103*d* for reading an original image of the top surface of the sheet P and a second scanning sensor 103*e* for reading the original image of the lower surface are disposed. Moreover, in the transport path for transporting the sheet P picked up by the supply roller 103*a* from the hopper 102*b*, seven transport drive rollers 104, and roller units 110 forming a pair with the rollers are disposed. Additionally, in FIG. 15, for reference numerals attached to the roller unit 110, the roller units common with each other in the set value of the torsion torque of the torsion spring 113 are denoted as 110-1, 110-2, respectively.

The transport drive rollers 104 are interlocked by a common driving motor (not shown) to synchronously rotate, and peripheral surfaces of the rollers are placed in contact with peripheral surfaces of the rollers 112 of the roller units 110-1, 110-2. In the roller unit 110-1, as shown in FIG. 10, the engaging arm 113*b* of the torsion spring 113 engages with the first stopper 111*e*, and the nipping force between the unit and the transport drive roller 104 with respect to the sheet P is set to be relatively weak. On the other hand, in the roller units 110-2 immediately before the first scanning sensor 103*d* and after the second scanning sensor 103*e*, the engaging arm 113*b* shown in FIG. 13 engages with the second stopper 111*f*. Therefore, the nipping force to the sheet P is strong before and after the first and second scanning sensors 103*d*, 103*e*, and nipping forces of other portions are smaller than this force.

In the image scanner constituted as described above, when an operation button 101*a*-1 of the operation panel 101*a* is turned on, the supply roller 103*a* starts rotating in an arrow direction in FIG. 15 to pick up one sheet P on the hopper 102*b*, and the sheet is passed and fed through the separation roller 103*b* and retard roller 103*c*. Subsequently, when a tip end of the sheet P is nipped by the first transport drive roller 104 and the roller 112 of the roller unit 110-1 (see FIGS. 10 to 13), the sheet P is detached from a supply roller 103*a* side, and the feed force is applied by the second to seventh transport drive rollers 104 and the roller units 110-1, 110-2 at a constant speed.

When the sheet P runs into the first transport drive roller 104 and roller unit 110-1 from the hopper 102*b*, the nipping force is set to be weak, the tip end of the sheet P is therefore easily nipped, and no sheet clogging occurs. Moreover, the sheet P passes between the fourth to last transport drive rollers 104 and roller units 110-1 in a circular arc form, but the nipping forces of these roller pairs are also set to be weak, the sheet P quickly passes, and the sheet clogging is similarly prevented. On the other hand, the nipping forces between the transport drive rollers 104 and the roller units 110-2 immediately before and after the first and second scanning sensors 103*d*, 103*e* are set to be strong, and slippage is therefore prevented when the sheet P is transported by these two roller pairs. Therefore, image reading can be executed with a high precision by the first and second scanning sensors 103*d*, 103*e*, and the image can be read without being streamed or dropped.

As described above, since the urging force of the torsion spring 113 of the roller unit 110 can be switched and used in two steps, the urging force of the spring incorporated in a portion in which the sheet P is easily clogged is weakened, and the urging force of an image reading or forming position is strengthened so that image processing is possible with a high precision.

Additionally, in the present embodiment, the urging force of the torsion spring 113 is switched in two steps by the first and second stoppers 111*e*, 111*f*, but the number of steps of setting the urging force can be increased by increasing the number of stoppers. Moreover, by disposing a manually rotated eccentric cam on the holder and allowing the engaging arm 113*b* to abut on the peripheral surface of the eccentric cam, the urging force can continuously be adjusted in a large number of steps.

In the roller unit according to a first aspect of the present invention, since the roller pressing force can arbitrarily be changed in accordance with a change of the torsion torque of the torsion spring, when pressing the sheet member for some processing operation, the roller pressing force suitable for the processing can be set and used to enhance general-purpose properties.

Moreover, in an image processing apparatus according to the first aspect in which the roller unit is disposed in the transport path, the sheet members such as paper can steadily be fed. Particularly, according to a second aspect, when the roller unit with a strengthened torsion torque is disposed immediately before and after an image reading scanning section or an image forming printer section, more stable image reading scanning or image printing is possible.

In a third aspect of the present invention, even when the separation roller and retard roller cannot prevent the multi-transport of the sheet members such as paper, only with the detection of the multi-transport by the multi-transport detection sensor on the downstream side, the hopper is lowered, the nipping force between the retard roller and the separation roller is released and the power supply amount to the retard motor utilizing the DC motor is increased to increase the rotation torque of the retard roller. Therefore, only one sheet member can be fed to the downstream side and the remaining sheet members can be returned to the hopper side. Therefore, the sheet member multi-transport can be prevented in two steps, and secure multi-transport prevention can be realized.

In the fourth aspect of the present invention, the adjustment of the nipping force between the separation roller and the retard roller and the adjustment of the set torque of the retard roller are controlled in accordance with the material property of the sheet member. Therefore, when means for informing the control system of the change of the material of the sheet member is disposed, the nipping force and set torque can automatically be set, and the sheet member multi-transport can securely be prevented.

In a fifth aspect of the present invention, the set torque of the retard roller and the nipping force between the retard roller and the separation roller can be set or changed and matched based on the number of multi-transports of the sheet members in such a manner that no multi-transport occurs. Therefore, even when supplying of the sheet from the hopper on which a mixture layer of various sheet members different in friction coefficients is mounted, the sheet member is handled in the learning functional manner and the multi-transport can securely be prevented.

What is claimed is:

1. A sheet member supply system in an image processing apparatus, provided with a hopper on which sheet members are piled, a supply roller for picking up said piled sheet members and feeding out the sheet members to an image processing system, a multi-transport preventing roller pair of a separation roller and a retard roller disposed on a downstream side of said supply roller and in an entrance to said image processing system, said hopper being movable with respect to said supply roller, said sheet member supply system comprising:

a multi-transport detector, disposed on an immediate downstream side of said roller pair of the separation roller and the retard roller, for detecting multi-transport of said sheet members, and a controller that, when sheet member multi-transport is detected by said multi-transport detector, performs controls to first shift said hopper in a downward direction apart from said supply roller, and then to decrease a nipping force between said separation roller and the retard roller and increase a rotation torque of said retard roller.

2. The sheet member supply system in the image processing apparatus according to claim 1 wherein said retard roller is included in a retard motor driving system utilizing a DC motor whose output shaft rotation torque is variable in accordance with a current application amount.

* * * * *